US010893738B2

(12) United States Patent
Berhault et al.

(10) Patent No.: US 10,893,738 B2
(45) Date of Patent: Jan. 19, 2021

(54) APPLICATOR FOR APPLYING COSMETIC PRODUCT, NOTABLY FOR APPLYING MASCARA TO THE EYELASHES

(71) Applicant: L'OREAL, Paris (FR)

(72) Inventors: Alain Berhault, Clichy (FR); Marc Borsari, Palmer, MA (US); Pierre Ducastin, Clichy (FR); Audrey Thenin, Clichy (FR); Eric Caulier, Clichy (FR)

(73) Assignee: L'OREAL, Paris (FR)

( * ) Notice: Subject to any disclaimer, the term of this patent is extended or adjusted under 35 U.S.C. 154(b) by 141 days.

(21) Appl. No.: 15/552,430

(22) PCT Filed: Feb. 25, 2016

(86) PCT No.: PCT/EP2016/054034
§ 371 (c)(1),
(2) Date: Aug. 21, 2017

(87) PCT Pub. No.: WO2016/135270
PCT Pub. Date: Sep. 1, 2016

(65) Prior Publication Data

US 2018/0042362 A1 Feb. 15, 2018

(30) Foreign Application Priority Data

Feb. 27, 2015 (FR) ..... 15 51688

(51) Int. Cl.
*A45D 40/26* (2006.01)
*A45D 34/04* (2006.01)
*A46B 11/00* (2006.01)

(52) U.S. Cl.
CPC ..... *A45D 40/262* (2013.01); *A45D 34/042* (2013.01); *A46B 11/001* (2013.01); *A46B 2200/1053* (2013.01)

(58) Field of Classification Search
CPC ..... A45D 40/262; A45D 34/042; A46B 2200/1053
See application file for complete search history.

(56) References Cited

U.S. PATENT DOCUMENTS 4,165,755 A * 8/1979 Cassai ..... A45D 40/265 132/218
D273,716 S * 5/1984 Cassai ..... D28/7
(Continued)

FOREIGN PATENT DOCUMENTS

EP 2 789 259 A1 10/2014
FR 2 874 160 A1 2/2006
(Continued)

OTHER PUBLICATIONS

International Search Report dated May 27, 2016 in PCT/EP2016/054034 filed Feb. 25, 2016.

*Primary Examiner* — Rachel R Steitz
*Assistant Examiner* — Brianne E Kalach
(74) *Attorney, Agent, or Firm* — Oblon, McClelland, Maier & Neustadt, L.L.P.

(57) ABSTRACT

The present invention relates to an applicator member (1) for an applicator for applying cosmetic product, notably for applying mascara to the eyelashes, said applicator member comprising a metal core (2) having an end (2*a*) for connecting to a gripping member (5), characterized in that said connecting end is shaped so as to be able to form a joint head that is able to engage in a corresponding housing in the gripping member, and in that said connecting end is produced by moulding in one piece with the metal core.

12 Claims, 1 Drawing Sheet

(56) References Cited

U.S. PATENT DOCUMENTS

| | | | | |
|---|---|---|---|---|
| 4,733,424 | A * | 3/1988 | Gurkin | B60R 3/04 15/161 |
| 5,328,282 | A * | 7/1994 | Charrier | A45D 34/048 401/127 |
| 6,026,823 | A * | 2/2000 | Gueret | A45D 34/046 132/218 |
| 8,556,528 | B2 * | 10/2013 | Gardner | A45D 40/265 401/122 |
| 9,339,098 | B2 * | 5/2016 | Takata | A45D 40/265 |
| 2007/0025803 | A1 | 2/2007 | Dieudonat | |
| 2011/0135376 | A1 * | 6/2011 | Weigel | A45D 40/24 401/29 |
| 2012/0045268 | A1 * | 2/2012 | Geuther | A45D 34/045 401/121 |
| 2014/0016984 | A1 * | 1/2014 | Kim | A45D 40/265 401/129 |
| 2014/0021773 | A1 * | 1/2014 | Bosari | A46B 3/18 300/21 |
| 2014/0109928 | A1 * | 4/2014 | Simard | A46B 5/0075 132/200 |
| 2015/0020835 | A1 | 1/2015 | Takata et al. | |
| 2015/0020836 | A1 | 1/2015 | Ramet et al. | |
| 2015/0164210 | A1 * | 6/2015 | Lou | A46B 9/021 401/129 |

FOREIGN PATENT DOCUMENTS

| | | | |
|---|---|---|---|
| FR | 2 898 257 | A1 | 9/2007 |
| FR | 2 987 244 | A1 | 8/2013 |
| JP | S 61-174515 | U | 10/1986 |
| KR | 20-0459831 | Y1 | 4/2012 |

* cited by examiner

APPLICATOR FOR APPLYING COSMETIC PRODUCT, NOTABLY FOR APPLYING MASCARA TO THE EYELASHES

The present invention relates to the application of a cosmetic product, in particular to human keratin fibres, notably the eyelashes.

More specifically, the present invention relates to an applicator member for an applicator for applying cosmetic product, in particular to keratin fibres, and notably for applying mascara to the eyelashes, said applicator member comprising a metal core having an end for connecting to a gripping member Numerous brushes, notably mascara brushes, that are formed by helically winding two arms of a metal wire that form a core around tufts of bristles extending radially from the metal wire are known. The arms are fixed in a stem made of plastics material and secured to a closure cap of a container containing the product to be applied. Such brushes are referred to as twisted core brushes.

In order to make it easier to apply the product, it is advantageous to be able to orient the brush with respect to its stem. This is particularly true for mascara brushes.

Therefore, orientable mascara brushes that make it possible notably to avoid applying product to the skin around the eye are known.

A first solution consists in providing a stem comprising an orientable stem portion. Such a solution is described for example in the document EP 1 369 056.

Such a solution is not ideal since a joint on the stem brings about a difference in the distance of the brush with respect to the hand. The precision of application is affected thereby.

A second solution is to provide a joint in the region of the applicator member for applying the cosmetic product.

The document US 2011/0135376 thus describes a cosmetic applicator comprising a mascara brush mounted at the end of a stem by way of a ball joint connection. The stem has an end portion that itself forms an applicator member.

However, the document US 2011/0135376 is directed at a brush produced by moulding a thermoplastic material and does not propose a solution for a brush with a metal core as described above.

Therefore, there is a need for a solution that makes it possible to orient a brush with a metal core on the end of a cosmetic applicator stem.

Documents JPH1099127 and EP2789259 disclose brushes with a twisted metal core, an end of said core being inserted and maintained inside a ball head in order to form a ball joint with a corresponding stem.

However, the brush needs to be assembled to the ball head, which adds an assembling step to the making process and a lower reliability.

The present invention aims to achieve these objectives and to this end proposes an applicator member for an applicator for applying cosmetic product, notably to keratin materials, in particular for applying mascara to the eyelashes. The applicator member comprises a metal core having an end for connecting to a gripping member, that said connecting end being shaped so as to be able to form a joint head that is able to engage in a corresponding housing in the gripping member, characterized in that that said connecting end is produced by moulding in one piece with the metal core.

Therefore, by moulding an end that forms a joint head made of the material of which the metal core is made, the applicator member can easily be mounted in an orientable manner at the end of a gripping member that has a suitable corresponding housing.

If need be, the brush can thus be rendered removable and exchangeable. It is therefore possible to provide a set of brushes that have different configurations and can thus be mounted interchangeably on the gripping member.

Moreover, the joint head is formed integrally with the core, thereby ensuring its good mechanical integrity.

Furthermore, since the core is made of a metal material, the joint head can be produced easily by heating said metal material up to a temperature allowing it to be shaped. This is a simple and relatively inexpensive process.

According to a first variant embodiment, the joint head is a ball joint head. Such a ball joint head makes it possible to form with the gripping member a ball joint connection that has three degrees of freedom. There are as many possibilities of orienting the applicator member with respect to the gripping member as possible.

Preferably, the connecting end has a spherical overall shape. The spherical shape allows a simple and relatively easy shaping.

According to a second variant embodiment, the joint head is a pivot joint head.

Preferably, the core is produced from an alloy, in particular an alloy of nickel, titanium, or from steel.

Advantageously, the metal core is produced by twisting at least two metal strands together. Also advantageously, the two metal strands are obtained from one and the same metal wire folded on itself.

Preferably, the core has a second end situated away from its connecting end, said second end being rounded. This makes it possible notably to limit the risk of injury.

According to a preferred embodiment, the applicator member is a brush, notably a mascara brush. To this end, the metal core bears a set of bristles that extend radially from said core.

Of course, the present invention is not limited to one particular type of applicator member, and further applicator members with a metal core are conceivable.

In an advantageously complementary manner, the connecting end of the applicator member has at least one orientation indexing element.

The present invention also relates to a cosmetic applicator comprising an applicator member mounted at a free end of a gripping member, characterized in that the applicator member is an applicator member according to the invention.

Preferably, the gripping member comprises a stem, the applicator member being mounted at one end of said stem.

Advantageously, the gripping member comprises a cap for a cosmetic product container.

The present invention furthermore relates to a device for applying a cosmetic product, comprising at least one container that is intended to form a reservoir for said cosmetic product, and at least one removable cap for closing and opening said reservoir, characterized in that the cap is a cosmetic applicator according to the invention, the applicator member being disposed inside the container when the cap closes said container.

Finally, the present invention relates to a makeup kit comprising at least one gripping member and a plurality of applicator members according to the invention.

The present invention will be understood better from reading the following detailed description with regard to the appended drawing, in which.

Figure 1:
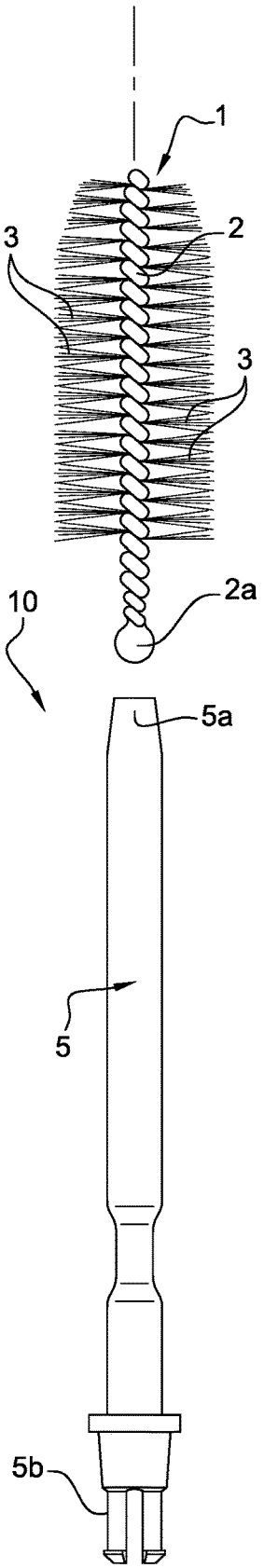
FIG. 1 is a schematic depiction of an applicator according to the invention, the applicator member being separated from the gripping member.
Figure 2:
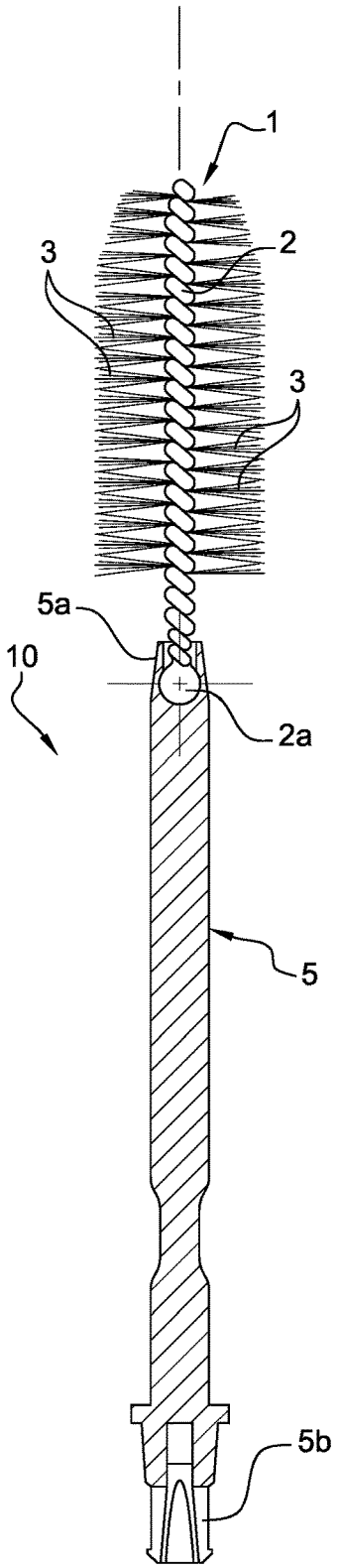
FIG. 2 is a schematic depiction in longitudinal section of the applicator from FIG. 1, the applicator member and the gripping member being assembled and aligned.
Figure 3:
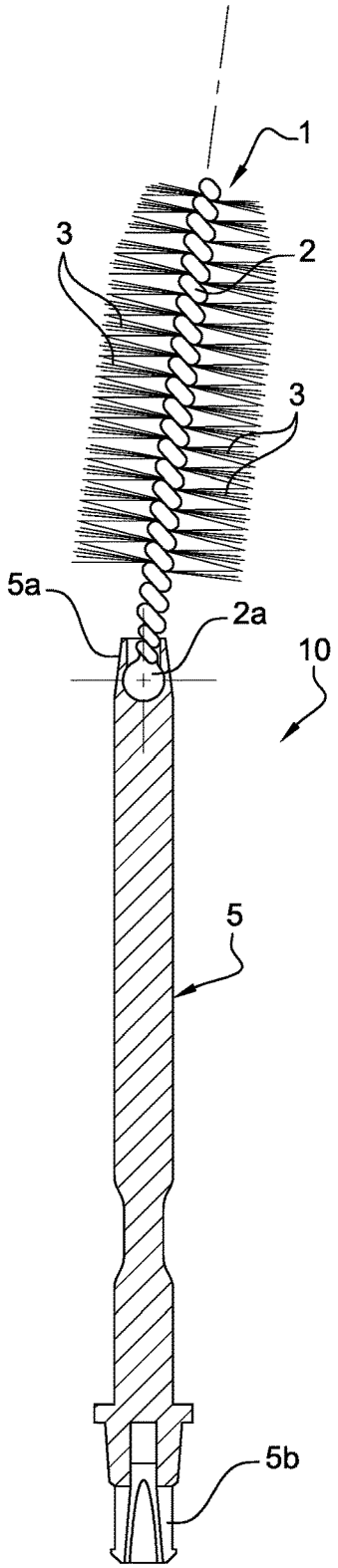
FIG. 3 is a schematic depiction in longitudinal section of the applicator from FIG. 2, the applicator member being oriented differently.

As shown in FIGS. 1 to 3, an applicator 10 for applying a cosmetic product, notably for applying mascara to the eyelashes, comprises an applicator member 1 and a gripping member 5.

The applicator member 1 comprises a metal core 2 formed by helically winding two arms of a metal wire which has been folded in a U-shape before the arms are twisted.

Preferably, the core 2 may be produced from a metal alloy, in particular from an alloy of nickel, titanium, or from steel.

Bristles 3 are implanted radially between the arms of the wire. When the arms of the wire are twisted, the bristles are clamped and held between the helical turns of the core 2. In this way, the applicator member 1 forms a brush.

Although illustrated by a brush, it should be noted that further types of applicator member having a metal core are possible.

The bristles 3 may be made of natural or synthetic fibres. The bristles may also possibly be flocked. The bristles 3 may be of different natures and/or types. They may for example have different diameters, different lengths, radially and/or longitudinally, different sections and/or different shapes.

The core 2 of the applicator member 1 may be straight, that is to say substantially rectilinear, or curved. The core 2 may also be central or off-centre with respect to a cross section of the applicator member 1, in this case with respect to a cross section of the brush.

The applicator member 1 is intended to be mounted at one end of the gripping member 5.

To this end, the metal core 2 of said applicator member 1 has a connecting end 2*a* which is shaped so as to be able to form a joint with the gripping member 5. More specifically, the connecting end 2*a* forms a joint head intended to engage with a corresponding housing in the gripping member.

In this case, the connecting end 2*a* has a spherical overall shape. The connecting end 2*a* thus forms a ball joint head.

The connecting end is produced in one piece with the core 2.

To this end, a terminal part of the metal wire forming the core 2 is heated up to a temperature allowing it to be shaped.

In the case of a curved core 2, said core 2 can be curved before or after the end 2*a* is shaped.

Such a shaping process is described in the document U.S. Pat. No. 8,783,787.

In particular, the end 2*a* forming a ball joint head is produced by high-energy fusion of a terminal portion of the metal wire forming the core 2. This heating step makes it possible to "melt" the end of the brush in order to shape it and produce the ball joint head produced in one piece with the core 2.

The end 2*a* forming a ball joint head is thus an integral part of the core 2 of the applicator member 1, a metallurgical connection being formed between the end 2*a* and the rest of the core 2. Moreover, when fused in this way at their end, the two arms of the metal wire are inseparable and cannot be untwisted.

Furthermore, it is important to note that such shaping does not require the use of any particular chemical agent.

Numerous heating techniques can be employed, in particular techniques used for welding. Thus, heating by way of laser, by way of an electric arc torch, a plasma torch, etc., can be cited. The heating method will be adapted to the material of which the core 2 is made.

The shaping of the end 2*a* by heating and fusion from the material of which the core 2 is made also makes it possible to produce an end 2*a* that has a smooth external surface that is easy to clean.

The end 2*a* is shaped so as to be able to produce a ball joint connection with a corresponding housing in the gripping member 5. In particular, the end 2*a* has a ball shape, that is to say a shape that is spherical overall.

The size of the end 2*a* formed in this way depends on the quantity of metal wire shaped. Depending on the desired size of the end 2*a*, it will be appropriate to provide a more or less long terminal portion of metal wire that is available.

The end 2*a* may be shaped, for example, in the following manner.

First of all, the applicator member 1 is fitted on a support for holding it in position. Preferably, the applicator member is held at a part of the core 2 that is situated close to the terminal portion intended to form the end 2*a*.

The terminal portion intended to form the end 2*a* is introduced through a refractory screen intended to protect the rest of the core 2 and the bristles 3 from the heat released during the fusion step.

The end 2*a* is subjected to a fusion device comprising a heating end for moulding the melted metal part into a ball.

Advantageously, the applicator member 1 has a second end 2*b* situated away from the end 2*a* having a rounded shape. When use is made of a single metal wire folded on itself, the U shape naturally constitutes such a rounded end 2*a*. When use is made of two separate metal arms, the method according to the document U.S. Pat. No. 8,783,787 can be used to produce such a rounded end 2*a*.

In order to form the applicator 10, the applicator member 2 is mounted at one end 5*a* of the gripping member 5 that is in the form of a stem.

The end 5*a* has a housing designed to receive the end 2*a* of the applicator member 2 and consequently has a shape substantially complementary to said end 2*a*.

The stem is preferably produced from a thermoplastic material, notably by moulding or extrusion.

The end 2*a* is force-fitted into the interior of the housing. A ball joint connection is thus formed.

Depending on the diameter of the opening in the housing in the end 5*a* and on the strength of the material of which the stem is made, the fitting of the applicator member 2 will require more or less force. The applicator member could thus be rendered removable by the user or designed not to be easily removable.

The internal dimension of the housing in the end 5*a* of the gripping member compared with the external dimension of the end 2*a* of the applicator member also makes it possible to vary the clamping force and the resistance to orientation of the brush.

A minimum resistance should be ensured in order that application of the product does not cause the brush to move and the orientation to change. There also exists a maximum resistance beyond which the ball joint could become difficult to handle by a user or beyond which the core 2 could twist.

Furthermore, the end 5*a* also makes it possible to define the amplitude of orientation of the applicator member 2 with respect to the gripping member 5. More specifically, the housing in the end 5*a* has an introduction neck having a lip such that it constitutes a stop for the applicator member 1.

Depending on the length of the introduction neck, the amplitude of travel of the applicator member 1 will be greater or lesser.

As shown in the figures, the end 2*a* forming a ball joint head is smooth.

Alternatively, the end 2*a* forming a ball joint head may be shaped so as to have irregularities of the tooth type (punctiform irregularities) or rib type (peripheral at least partially elongate irregularities) that are able to engage with one or more corresponding cavities in the housing in the end 5*a*. The teeth or ribs thus make it possible to clip the applicator member in one or more given orientations.

Of course, the reverse configuration is possible, i.e. providing the teeth or irregularities inside the housing in the end 5*a* of the gripping member 5, the corresponding cavities being provided on the end 2*a* forming a ball joint head.

By way of example, the production of positioning teeth and spikes on a joint, in particular a ball joint, is described in the document KR20110107224.

Alternatively, it is also possible to produce one or more peripheral ribs, in different inclinations, that are able to engage with one or more corresponding grooves that have different inclinations.

For example, the end 2*a* forming a ball joint head may have a peripheral rib that extends in a plane substantially perpendicular to a longitudinal axis of the core 2 of the applicator member 1. In a complementary manner, the housing in the end 5*a* of the gripping member 5 could then have a peripheral groove that likewise extends in a plane substantially perpendicular to a longitudinal axis of the gripping member 5. Further peripheral grooves which are oriented differently could make it possible to define different inclined positions.

In particular, provision could be made of positioning elements for ensuring at least one clipping of the applicator member 1 in a position such that a longitudinal axis of the core 2 coincides more or less with a longitudinal axis of the gripping member 5 (alignment of the applicator member 1 with the gripping member 5). In a complementary manner, the positioning elements will make it possible to ensure clipping of the applicator member 1 in a position such that the longitudinal axis of the core 2 forms a non-zero angle with a longitudinal axis of the gripping member 5. Preferably, several angles will be possible, in one or more radial directions.

The gripping member 5 is intended to be fixed to a container cap and, to this end, has an end 5*b* having clipping elements. These clipping elements are intended to engage with corresponding elements on the cap.

Although illustrated by way of an applicator member 1 having a connecting end 2*a* that forms a ball joint connecting head, further forms of the joint are conceivable, and the connecting end 2*a* may notably form a pivot joint head.

Such a connecting end could be produced simply by flattening the spherical end so as to obtain a substantially flat connecting end having a substantially circular cross section (representing a profile similar to that in FIGS. 1 to 3). The housing in the gripping member 5 is accordingly shaped and can then be in the form of a slot with a circular end.

The pivot connection thus formed can be smooth or have positioning elements as described above.

The invention claimed is:

1. An applicator member for an applicator for applying a cosmetic product to eyelashes, said applicator member comprising:

a metal core having a connecting end for connecting to a gripping member, said connecting end being shaped so as to form a joint head that is able to engage in a corresponding housing in the gripping member, wherein said connecting end is produced by molding in one piece with the metal core, wherein the metal core is comprised of at least two metal strands twisted together, wherein the joint head is a ball joint head, and wherein the connecting end has at least one orientation indexing element.

2. The applicator member according to claim 1, wherein the joint head has a spherical overall shape.

3. The applicator member according to claim 1, wherein the joint head is a pivot joint head.

4. The applicator member according to claim 1, wherein the two metal strands are obtained from one and the same metal wire folded on itself.

5. The applicator member according to claim 1, wherein the core has a second end situated away from its connecting end, said second end being rounded.

6. The applicator member according to claim 1, wherein said applicator member is a mascara brush.

7. A cosmetic applicator comprising:

an applicator member mounted at a free end of a gripping member, wherein the applicator member is an applicator member according to claim 1.

8. A cosmetic applicator according to claim 7, wherein the gripping member comprises a stem, the applicator member being mounted at one end of said stem.

9. A cosmetic applicator according to claim 7, wherein the gripping member forms a cap for a cosmetic product container.

10. A device for applying a cosmetic product, comprising at least one container that is intended to form a reservoir for said cosmetic product, and at least one removable cap for closing and opening said reservoir, wherein the cap is a cosmetic applicator according to claim 9, the applicator member being disposed inside the container when the cap closes said container.

11. A makeup kit comprising at least one gripping member and a plurality of applicator members according to claim 1.

12. The applicator member according to claim 1, wherein said cosmetic product is mascara.

* * * * *